US010423118B1

(12) United States Patent
Mizoguchi et al.

(10) Patent No.: US 10,423,118 B1
(45) Date of Patent: Sep. 24, 2019

(54) CLEANING MEMBER AND IMAGE FORMING APPARATUS

(71) Applicant: FUJI XEROX CO., LTD., Tokyo (JP)

(72) Inventors: Satoshi Mizoguchi, Kanagawa (JP); Fuyuki Kano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/057,833

(22) Filed: Aug. 8, 2018

(30) Foreign Application Priority Data

Apr. 5, 2018 (JP) ..... 2018-073249

(51) Int. Cl.
*G03G 15/02* (2006.01)
*G03G 21/00* (2006.01)

(52) U.S. Cl.
CPC ..... *G03G 21/007* (2013.01); *G03G 15/0225* (2013.01)

(58) Field of Classification Search
CPC ..... G03G 15/0225; G03G 21/0057; G03G 21/007
USPC ..... 399/91, 98–100, 107, 110, 123
See application file for complete search history.

(56) References Cited

U.S. PATENT DOCUMENTS 8,538,287 B2 * 9/2013 Kawai ..... G03G 21/0058 399/100
9,639,019 B2 * 5/2017 Kano ..... G03G 15/0225
9,989,914 B2 * 6/2018 Yada ..... G03G 15/0225

FOREIGN PATENT DOCUMENTS

JP 2013-152492 8/2013

* cited by examiner

*Primary Examiner* — Hoan H Tran
(74) *Attorney, Agent, or Firm* — JCIPRNET

(57) ABSTRACT

A cleaning member includes a core and first and second foamed elastic layers wound around an outer peripheral surface of the core in a double-helical pattern. The compressive stress F1 of the first foamed elastic layer is greater than the compressive stress F2 of the second foamed elastic layer. The cleaning member cleans a member to be cleaned with the first and second foamed elastic layers in contact with a surface of the member to be cleaned.

20 Claims, 7 Drawing Sheets

CLEANING MEMBER AND IMAGE FORMING APPARATUS

CROSS-REFERENCE TO RELATED APPLICATIONS

This application is based on and claims priority under 35 USC 119 from Japanese Patent Application No. 2018-073249 filed Apr. 5, 2018.

BACKGROUND

Technical Field

The present invention relates to a cleaning member and an image forming apparatus.

SUMMARY

According to an aspect of the invention, there is provided a cleaning member including a core and first and second foamed elastic layers wound around the outer peripheral surface of the core in a double-helical pattern. The compressive stress F1 of the first foamed elastic layer is greater than the compressive stress F2 of the second foamed elastic layer. The cleaning member cleans a member to be cleaned with the first and second foamed elastic layers in contact with a surface of the member to be cleaned.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the accompanying drawings.

Configuration of Image Forming Apparatus

Figure 1:
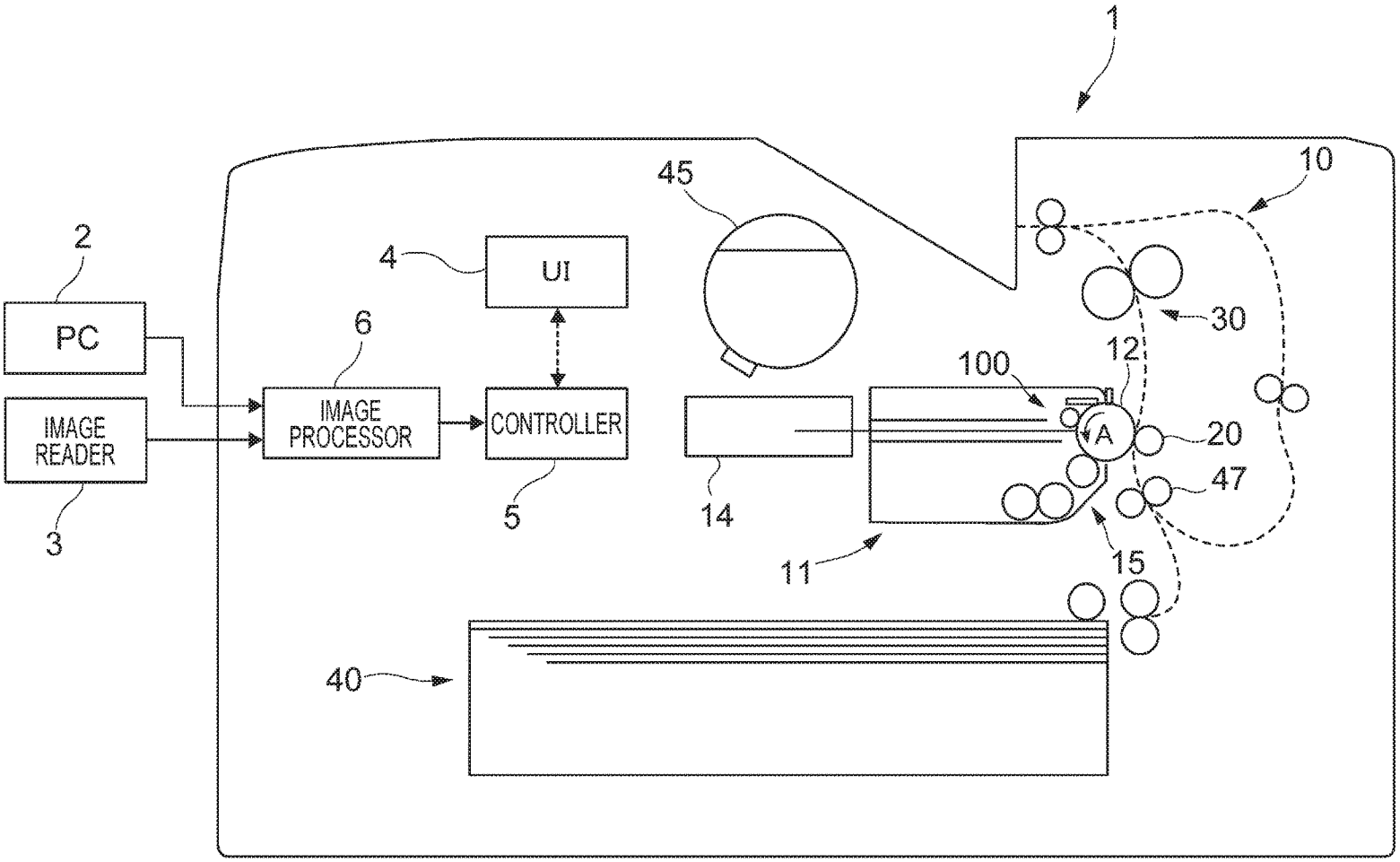
FIG. 1 illustrates an exemplary configuration of an image forming apparatus according to an exemplary embodiment.

FIG. 1 illustrates an exemplary configuration of an image forming apparatus 1 according to an exemplary embodiment. The illustrated image forming apparatus 1 is a monochrome printer including an image forming unit 10 that forms an image corresponding to image data; a user interface (UI) 4 that receives an instruction from a user and displays, for example, a message for the user; a controller 5 that controls the operation of the entire image forming apparatus 1; and an image processor 6 that is connected to external devices such as a personal computer (PC) 2 and an image reader 3 and processes image data received therefrom.

The image forming apparatus 1 further includes a recording medium feeding unit 40 that feeds recording media to the image forming unit 10 and a toner cartridge 45 that supplies toner to the image forming unit 10.

Figure 2:
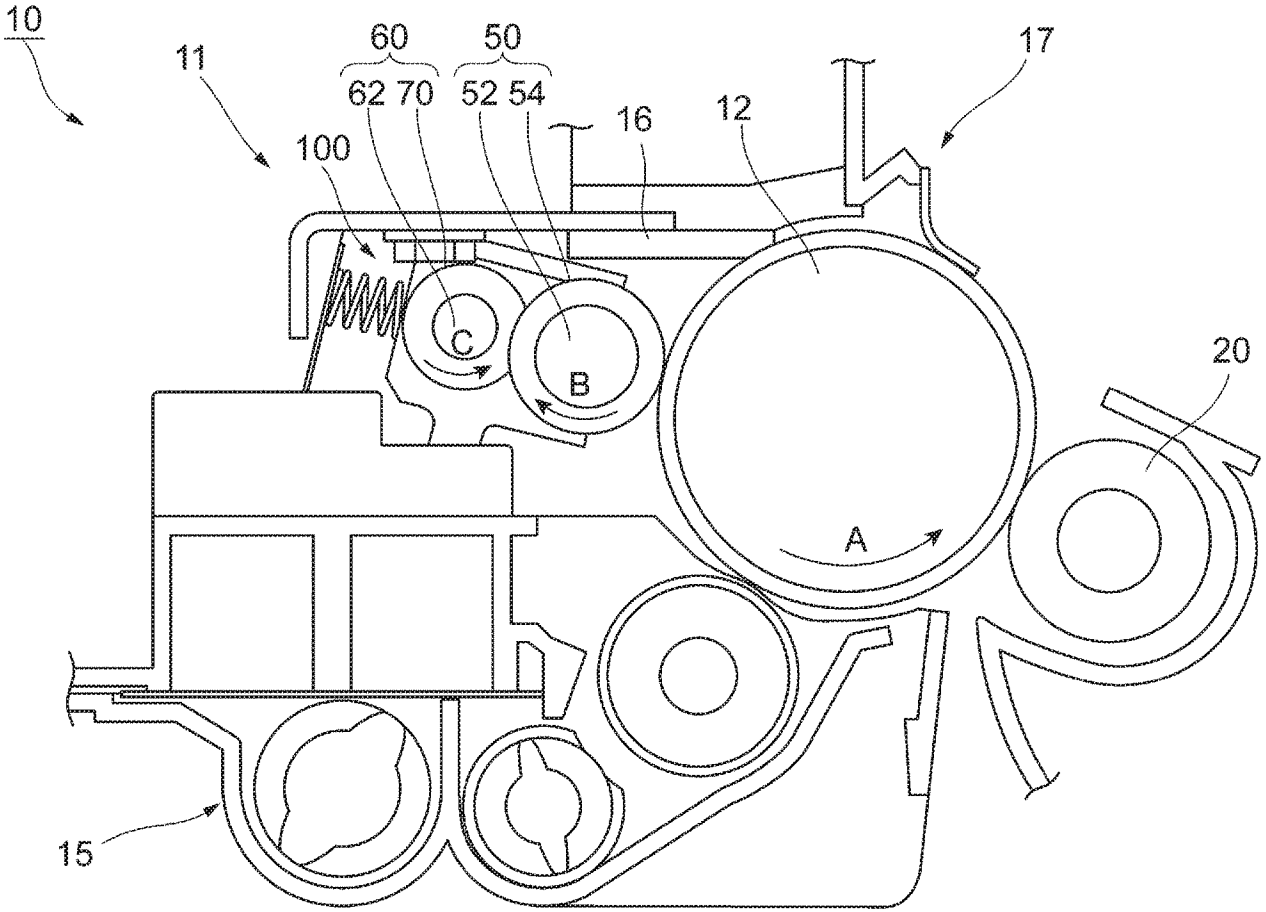
FIG. 2 illustrates an exemplary configuration of an image forming unit according to an exemplary embodiment.

FIG. 2 illustrates an exemplary configuration of the image forming unit 10 according to an exemplary embodiment.

As shown in FIGS. 1 and 2, the image forming unit 10 includes a photoconductor drum 12 that is rotatably disposed, that allows an electrostatic latent image to be formed thereon, and that carries a toner image, the photoconductor drum 12 being an example of an object to be charged; a charging device 100 that charges a surface of the photoconductor drum 12; an exposure device 14 that exposes, on the basis of image data, the photoconductor drum 12 charged by the charging device 100; a developing device 15 that develops an electrostatic latent image formed on the photoconductor drum 12; and a cleaner 16 that cleans the surface of the photoconductor drum 12 after transfer. The photoconductor drum 12 in the exemplary embodiment includes a rotating shaft (not shown) having an axis extending from the front (out of the page) to the rear (into the page) of the image forming apparatus 1.

The image forming unit 10 further includes a transfer roller 20 that forms a transfer nip with the photoconductor drum 12 and transfers a toner image formed on the photoconductor drum 12 to a recording medium; and a fixing device 30 that fixes the transferred toner image to the recording medium.

The image forming unit 10 further includes a stripper 17 that strips, from the surface of the photoconductor drum 12, the recording medium to which the toner image is transferred by the transfer roller 20.

In the image forming unit 10 according to the exemplary embodiment, the photoconductor drum 12, the charging device 100, the developing device 15, the cleaner 16, and the stripper 17 are integrated into an image forming module 11. The image forming module 11 is attachable to and detachable from the image forming apparatus 1 and is replaceable, for example, at the end of the life of the photoconductor drum 12.

In this image forming apparatus 1, the image forming unit 10 performs an image formation process on the basis of various control signals fed from the controller 5. Specifically, under the control of the controller 5, image data input from the PC 2 or the image reader 3 is processed by the image processor 6 and is fed to the image forming unit 10. In the image forming unit 10, while the photoconductor drum 12 is rotated in the direction of an arrow A, the photoconductor drum 12 is charged to a predetermined potential by the charging device 100 and is exposed by the exposure device 14 that radiates light on the basis of the image data transmitted from the image processor 6. As a result of this, an electrostatic latent image corresponding to the image data is formed on the photoconductor drum 12. The electrostatic latent image formed on the photoconductor drum 12 is then developed, for example, as a black (K) toner image by the developing device 15 to form a toner image corresponding to the image data on the photoconductor drum 12.

The toner image formed on the photoconductor drum 12 is electrostatically transferred, by the transfer roller 20, to a recording medium transported to the transfer nip.

Thereafter, the recording medium to which the toner image is transferred is stripped from the surface of the photoconductor drum 12 by the stripper 17 and is transported to the fixing device 30. The toner image on the recording medium transported to the fixing device 30 is fixed to the recording medium with heat and pressure by the fixing device 30. The recording medium on which a fixed image is formed is transported to a paper output stacker (not shown) of the image forming apparatus 1.

The toner (residual toner) deposited on the surface of the photoconductor drum 12 after transfer is removed from the surface of the photoconductor drum 12 by the cleaner 16 after transfer is complete.

In this manner, the image formation process is repeated for the number of cycles corresponding to the number of prints.

Configuration of Charging Device

Next, a configuration of the charging device 100 according to an exemplary embodiment will be described.

As shown in FIG. 2, the charging device 100 includes a charging roller 50 that is rotatably supported and that charges the photoconductor drum 12, the charging roller 50 being an example of a charging member or a member to be cleaned; and a cleaning roller 60 that is rotatably supported and that cleans a surface of the charging roller 50, the cleaning roller 60 being an example of a cleaning member.

Here, as described above, the photoconductor drum 12 includes a rotating shaft having an axis extending from the front to the rear of the image forming apparatus 1. The charging roller 50 and the cleaning roller 60 of the charging device 100 are disposed along the axial direction of the photoconductor drum 12.

The charging roller 50 and the cleaning roller 60 are pressed against the photoconductor drum 12 by an elastic member (not shown). Thus, a charging layer 54, which will be described later, of the charging roller 50 is in pressed contact with the surface of the photoconductor drum 12. A foamed elastic layer 70, which will be described later, of the cleaning roller 60 is in pressed contact with the charging layer 54 of the charging roller 50.

In the exemplary embodiment, the charging roller 50 is driven by the rotation of the photoconductor drum 12, which is driven by a driving unit (not shown), to rotate in the direction of an arrow B. Furthermore, the cleaning roller 60 is driven by the rotation of the charging roller 50 to rotate in the direction of an arrow C.

Configuration of Charging Roller

Next, the charging roller 50 will be described.

The charging roller 50 according to an exemplary embodiment includes a charging shift 52 that is disposed along the rotating shaft of the photoconductor drum 12 and that is rotatably supported by bearings (not shown); and the charging layer 54 that is disposed around the periphery of the charging shift 52 and that is in contact with the surface of the photoconductor drum 12 to charge the photoconductor drum 12.

The charging shift 52 is formed of a conductive material such as a metal or an alloy. The charging shift 52 may be formed by treating the surface of a nonconductive material to be conductive, for example, by plating treatment.

The charging shift 52 has a cylindrical shape, and its opposite ends protrude from the opposite ends of the charging layer 54. The opposite ends of the charging shift 52 protruding from the charging layer 54 are rotatably supported by bearings (not shown), and a voltage is applied to one of the ends through the bearing by a power supply unit (not shown).

For example, the charging layer 54 is formed of a conductive elastic layer disposed on the charging shift 52 and a surface layer disposed on the conductive elastic layer.

The conductive elastic layer of the charging layer 54 may be formed by adding a conductor to an elastic material. The conductive elastic layer may optionally contain any additives commonly added to rubber, such as softeners, plasticizers, curing agents, vulcanizing agents, vulcanization accelerators, age resistors, and fillers such as silica and calcium carbonate.

Examples of elastic materials that may be used to form the conductive elastic layer include rubber materials such as silicone rubber, ethylene-propylene rubber, epichlorohydrin-ethylene oxide copolymer rubber, epichlorohydrin-ethylene oxide-allyl glycidyl ether copolymer rubber, and acrylonitrile-butadiene copolymer rubber. These may be used alone or as a mixture of two or more.

Examples of conductors that may be used include electronic conductors and ionic conductors. Examples of electronic conductors include fine powders of carbon blacks such as Ketjen black and acetylene black; pyrolytic carbon and graphite; conductive metals and alloys such as aluminum, copper, nickel, and stainless steel; conductive metal oxides such as tin oxide, indium oxide, titanium oxide, tin oxide-antimony oxide solid solutions, and tin oxide-indium oxide solid solutions; and insulating materials surface-treated to be conductive. Examples of ionic conductors include perchlorates and chlorates of oniums such as tetraethylammonium and lauryltrimethylammonium; and perchlorates and chlorates of alkali metals and alkaline earth metals such as lithium and magnesium.

These conductors may be used alone or in a combination of two or more. The amount of conductor added is not particularly limited. In the case of an electronic conductor, the amount thereof may be in the range of from 1 part by mass to 60 parts by mass relative to 100 parts by mass of the elastic material. In the case of an ionic conductor, the amount thereof may be in the range of from 0.1 parts by mass to 5.0 parts by mass relative to 100 parts by mass of the elastic material.

The surface layer of the charging layer 54 is for preventing the charging layer 54 from being contaminated by foreign matter such as residual toner. The material of the surface layer may be, for example, a resin or rubber. Specific examples include polyesters, polyimides, nylon copolymers, silicone resins, acrylic resins, polyvinyl butyrals, ethylene tetrafluoroethylene copolymers, melamine resins, fluorocarbon rubbers, epoxy resins, polycarbonates, polyvinyl alcohols, celluloses, polyvinylidene chlorides, polyvinyl chlorides, polyethylenes, and ethylene-vinyl acetate copolymers.

A conductive material may be incorporated into the surface layer in order to adjust the resistance value thereof. Examples of conductive materials include carbon black, conductive metal oxides, and ionic conductors. The conductive material may be a powder having a particle size of 3 μm or less. A single conductive material may be used alone, or two or more conductive materials may be used in combination.

Furthermore, insulating particles such as alumina and silica may be incorporated into the surface layer.

Depending on, for example, the particle size, the content, and the dispersion state of the particles contained in the surface layer, irregularities are formed in the surface of the charging roller 50, more particularly, the surface of the charging layer 54 of the charging roller 50. When irregularities are formed in the surface of the charging roller 50, the charging performance of the photoconductor drum 12 may be greater than when, for example, the surface of the charging roller 50 is smooth. In addition, filming, i.e., the phenomenon in which toner and external additives for toner adhering to the surface of the charging roller 50 are rubbed onto the surface of the photoconductor drum 12 and adhere to the surface in the form of a thin film may be suppressed. Furthermore, the friction between the charging roller 50 and the photoconductor drum 12 may be reduced, and the wear resistance between the charging roller 50 and the photoconductor drum 12 may be improved.

Here, an average spacing Sm of the irregularities in the surface of the charging roller 50 is a measure of the surface roughness of the charging layer 54 in accordance with JIS B 0601 (1994). The average spacing Sm of the irregularities in the exemplary embodiment is determined by sampling a segment from a roughness curve by a standard length in the direction of the mean line, calculating the sum of the lengths of portions of the mean line each extending between points corresponding to one peak and its neighboring valley within the sampled segment, and expressing the arithmetic mean spacing of the numerous irregularities in micrometers (μm).

In the exemplary embodiment, the average spacing Sm of the irregularities in the surface of the charging roller 50 is measured with a contact surface profilometer (SURFCOM 570, manufactured by Tokyo Seimitsu Co., Ltd.) in an environment at a temperature of 23° C. and a relative humidity of 55%. The measurement distance is 2.5 mm. A diamond-tipped stylus (5 μm in radius, 90° cone) is used. The average of three measurements taken at different sites is used as the average spacing Sm of the irregularities in the surface of the charging roller 50.

In the exemplary embodiment, the average spacing Sm of the irregularities in the surface of the charging roller 50 is preferably in the range of from 50 μm to 300 μm, more preferably from 70 μm to 250 μm, for the reasons described above such as improving the charging performance on the photoconductor drum 12, suppressing filming, and improving the wear resistance between the charging roller 50 and the photoconductor drum 12.

Here, as described above, irregularities are formed in the surface of the charging roller 50 for reasons such as improving the charging performance on the photoconductor drum 12, suppressing filming, and improving the wear resistance between the charging roller 50 and the photoconductor drum 12. When the surface of the charging roller 50 having such irregularities is cleaned with a cleaning roller having a foamed elastic layer, foreign matter may remain on the surface (particularly in recesses) of the charging roller 50 depending on, for example, the configuration of the foamed elastic layer. Some of the scraped-off foreign matter may remain on the surface of the charging roller 50, and foreign matter may be deposited on the irregularities in the surface of the charging roller 50. An increased amount of deposition of foreign matter or in-plane variation due to local deposition of foreign matter on areas such as projections may vary the charging characteristics of the charging roller 50.

To address these problems, the cleaning roller 60 according to the exemplary embodiment has the following configuration, so that an increase of foreign matter deposited on the surface of the charging roller 50 may be suppressed, while in-plane variation in the presence of foreign matter may be suppressed, and thus cleaning performance that is less likely to degrade and that is maintained over an extended period of time may be achieved.

Configuration of Cleaning Roller

Figure 3:
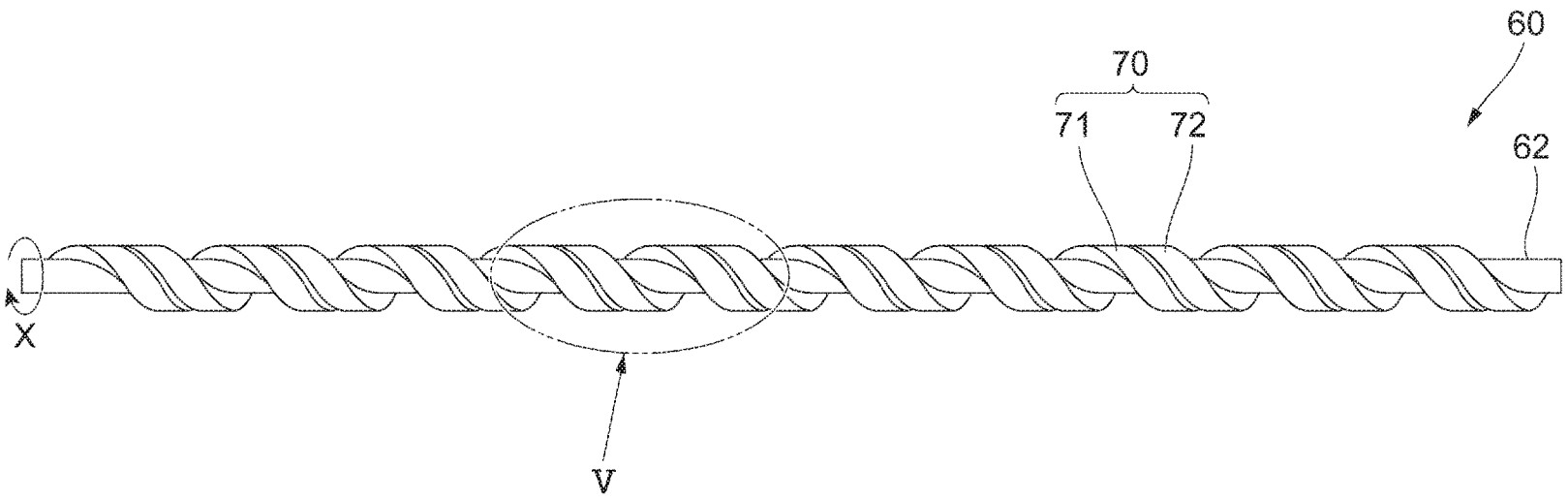
FIG. 3 illustrates a configuration of a cleaning roller according to an exemplary embodiment.
Figure 4:
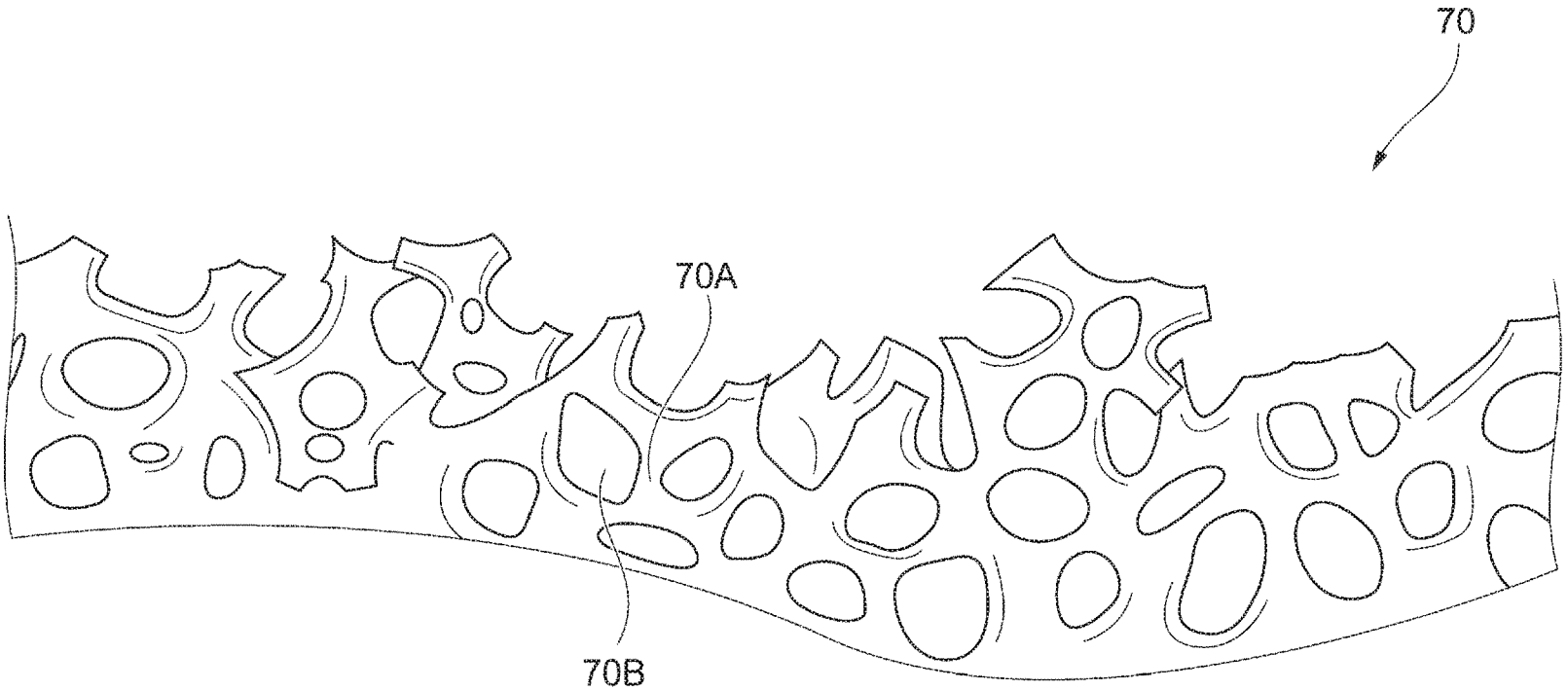
FIG. 4 is an enlarged view of a foamed elastic layer of the cleaning roller according to the exemplary embodiment.

Next, a configuration of the cleaning roller 60 according to an exemplary embodiment will be described. FIG. 3 illustrates the configuration of the cleaning roller 60 according to the exemplary embodiment. FIG. 3 shows the cleaning roller 60 as viewed from the direction perpendicular to the rotating shaft of the photoconductor drum 12. FIG. 4 is an enlarged view of the foamed elastic layer 70, which will be described later, of the cleaning roller 60 according to the exemplary embodiment. FIG. 4 corresponds to a side view of the foamed elastic layer 70 wound around a core 62, which will be described later, in a helical pattern, as viewed from an axial direction Q described later.

The cleaning roller 60 includes the core 62 that is disposed along the rotating shaft of the photoconductor drum 12 and that is rotatably supported by bearings (not shown). The cleaning roller 60 also includes the foamed elastic layer 70 that includes first and second foamed elastic layers 71 and 72 disposed around the outer periphery of the core 62 in a double-helical pattern and that is in contact with the surface of the charging roller 50 (the charging layer 54) to clean the surface of the charging roller 50. As will be described in detail later, in the cleaning roller 60 according to the exemplary embodiment, the foamed elastic layer 70 (the first and second foamed elastic layers 71 and 72) is bonded to the core 62 with an adhesive layer 65 (see, for example, FIGS. 6A and 6B described later) interposed therebetween.

The core 62 is formed of a material such as a metal, an alloy, or a resin. Examples of metals and alloys include metals such as iron (e.g., free-cutting steel), copper, brass, aluminum, and nickel and alloys such as stainless steel. Examples of resins include polyacetal resins. When the core 62 is formed of a metal or an alloy, the surface thereof may be subjected to surface treatment such as plating treatment. When the core 62 is formed of a nonconductive material such as a resin, the core 62 may be surface-treated to be conductive, for example, by plating treatment or may be used without such treatment.

The core 62 according to the exemplary embodiment has a cylindrical shape, and its opposite ends protrude from the opposite ends of the foamed elastic layer 70 and are rotatably supported by bearings (not shown). The core 62 may have an outer diameter of, for example, from 2 mm to 12 mm.

The foamed elastic layer 70 is a layer that is formed of what is called a foam having bubbles and that is formed of an elastic material that returns to its original shape when deformed by the application of an external force of 100 Pa. As shown in FIG. 4, the first and second foamed elastic layers 71 and 72 constituting the foamed elastic layer 70 each include a continuous skeletal portion 70A and plural cells 70B defined by the surrounding skeletal portion 70A.

As described above, the first and second foamed elastic layers 71 and 72 of the foamed elastic layer 70 are wound around the outer periphery of the core 62 in a double-helical pattern.

In the foamed elastic layer 70 according to the exemplary embodiment, a compressive stress F1 of the first foamed elastic layer 71 is greater than a compressive stress F2 of the second foamed elastic layer 72.

Here, in the cleaning roller 60 according to the exemplary embodiment, the first foamed elastic layer 71, whose compressive stress F1 is greater than the compressive stress F2 of the second foamed elastic layer 72, contributes to scraping off of foreign matter on the irregular surface (mainly in recesses) of the charging roller 50. Specifically, since the compressive stress F1 of the first foamed elastic layer 71 is greater than the compressive stress F2 of the second foamed elastic layer 72, the first foamed elastic layer 71 is provided with rigidity sufficient to scrape off foreign matter on the irregular surface of the charging roller 50 and hence contributes to scraping off of foreign matter.

On the other hand, in the cleaning roller 60 according to the exemplary embodiment, the second foamed elastic layer 72, whose compressive stress F2 is less than the compressive stress F1 of the first foamed elastic layer 71, functions to level, on the surface of the charging roller 50, foreign matter remaining on the surface of the charging roller 50 and foreign matter scraped by the first foamed elastic layer 71 but remaining on the surface of the charging roller 50. Specifically, since the compressive stress F2 of the second foamed elastic layer 72 is less than the compressive stress F1 of the first foamed elastic layer 71, the second foamed elastic layer 72 tends to conform to the shapes of the irregularities in the surface of the charging roller 50 and foreign matter remaining on the surface of the charging roller 50. This allows the second foamed elastic layer 72 to readily level foreign matter on the surface of the charging roller 50, and thus the in-plane variation of foreign matter present on the surface of the charging roller 50 may be suppressed.

In the cleaning roller 60 according to the exemplary embodiment, since the first and second foamed elastic layers 71 and 72 are disposed in a double-helical pattern, the scraping off of foreign matter by the first foamed elastic layer 71 and the leveling of foreign matter by the second foamed elastic layer 72 are alternately and continuously performed on the surface of the charging roller 50.

With this configuration, the charging device 100 according to the exemplary embodiment is less likely to experience, on the surface of the charging roller 50, an increase of foreign matter and in-plane variation in the presence of foreign matter. As a result of this, the degradation in the cleaning performance of the charging roller 50 due to the cleaning roller 60 may be reduced, and the cleaning performance may be maintained over a long period of time.

Here, the compressive stress of the foamed elastic layer 70 (the first and second foamed elastic layers 71 and 72) according to the exemplary embodiment is measured in the following manner in accordance with the method described in JIS K 7220 (2006). First, the foamed elastic body constituting the foamed elastic layer 70 is cut into 100 mm×100 mm to prepare a test specimen. The thickness of the test specimen is the thickness of the foamed elastic layer 70 (a thickness T1 of the first foamed elastic layer 71 and a thickness T2 of the second foamed elastic layer 72). The cut-out foamed elastic body is then compressed in the thickness direction at a compression rate of 50 mm/min by using a precision force tester (manufactured by Aikoh Engineering Co., Ltd.) to measure its compressive stress at 40% deformation. The measurement of compressive stress at 40% deformation is performed in an environment at a temperature of 23° C. and a relative humidity of 55%.

In the same manner, three test specimens are measured for their compressive stress at 40% deformation, and their average values are used as the compressive stresses F1 and F2 of the foamed elastic layer 70 (the first and second foamed elastic layers 71 and 72).

In the exemplary embodiment, the compressive stress F1 of the first foamed elastic layer 71 is preferably from 10 kPa to 20 kPa or from about 10 kPa to about 20 kPa, more preferably from 15 kPa to 18 kPa or from about 15 kPa to about 18 kPa, for ease of scraping off of foreign matter on the irregularities (mainly in recesses) in the surface of the charging roller 50.

The compressive stress F2 of the second foamed elastic layer 72 is preferably from 7 kPa to 12 kPa or from about 7 kPa to about 12 kPa, more preferably from 8 kPa to 10 kPa or from about 8 kPa to about 10 kPa, for ease of leveling of foreign matter remaining on the surface of the charging roller 50.

Furthermore, from the same viewpoints, F1/F2, which is the ratio of the compressive stress F1 of the first foamed elastic layer 71 to the compressive stress F2 of the second foamed elastic layer 72, is preferably from 1 to 2 or from about 1 to about 2, more preferably from 1.5 to 1.9 or from about 1.5 to about 1.9.

To allow the first foamed elastic layer 71 to easily enter the irregularities in the surface of the charging roller 50 and easily exhibit the function of scraping off foreign matter on the surface (mainly in recesses) of the charging roller 50, an average skeleton size D1 of the first foamed elastic layer 71 may be smaller than an average skeleton size D2 of the second foamed elastic layer 72.

Furthermore, from the viewpoint described above, the average skeleton size D1 of the first foamed elastic layer 71 may be smaller than the average spacing Sm of the irregularities in the surface of the charging roller 50. More specifically, the average skeleton size D1 of the first foamed elastic layer 71 is preferably from 0.3 times to 0.8 times, more preferably from 0.5 times to 0.7 times the average spacing Sm of the irregularities in the surface of the charging roller 50.

Furthermore, to provide rigidity sufficient to scrape off foreign matter on the surface of the charging roller 50, the average skeleton size D1 of the first foamed elastic layer 71 may be at least 0.3 times the average spacing Sm of the irregularities in the surface of the charging roller 50. For the same reason, the average skeleton size D1 of the first foamed elastic layer 71 may be 30 μm or more.

To allow the second foamed elastic layer 72 to easily exhibit the function of leveling foreign matter remaining on the surface of the charging roller 50, the average skeleton size D2 of the second foamed elastic layer 72 is preferably from 1.2 times to 3.2 times, more preferably from 1.5 times to 2.5 times, still more preferably from 1.5 times to 2.0 times the average spacing Sm of the irregularities in the surface of the charging roller 50.

To provide conformability to the surface shape of the charging roller 50, the average skeleton size D2 of the second foamed elastic layer 72 may be 3.2 times the average spacing Sm of the irregularities in the surface of the charging roller 50. For the same reason, the average skeleton size D2 of the second foamed elastic layer 72 may be 600 μm or less.

Here, the average skeleton size D1 of the first foamed elastic layer 71 and the average skeleton size D2 of the second foamed elastic layer 72 each mean the average value of shortest distances between adjacent cells 70B, that is, minimum thicknesses of skeletal portions 70A that separate adjacent cells 70B from each other.

The average skeleton size D1 or the average skeleton size D2 is measured as follows. First, regions near the surfaces of the first and second foamed elastic layers 71 and 72 disposed around the outer peripheral surface of the core 62 are observed from the side thereof under a VHX-900 microscope (manufactured by KEYENCE) at 100× magnification. Cells 70B present in regions extending 2 mm from the surfaces of the first and second foamed elastic layers 71 and 72 are identified, and the shortest distance between adjacent cells 70B (the minimum thickness of skeletal portions 70A that separate adjacent cells 70B from each other) is measured at ten points. The measured values are then averaged to determine the average skeleton size D1 of the first foamed elastic layer 71 and the average skeleton size D2 of the second foamed elastic layer 72.

Next, the properties of the foamed elastic layer 70 (the first and second foamed elastic layers 71 and 72), such as helix widths W1 and W2, helix angles θ1 and θ2, thicknesses T1 and T2, separation distance d between the first and second foamed elastic layers 71 and 72, and helix pitch R of the foamed elastic layer 70, will be described.

Figure 5:
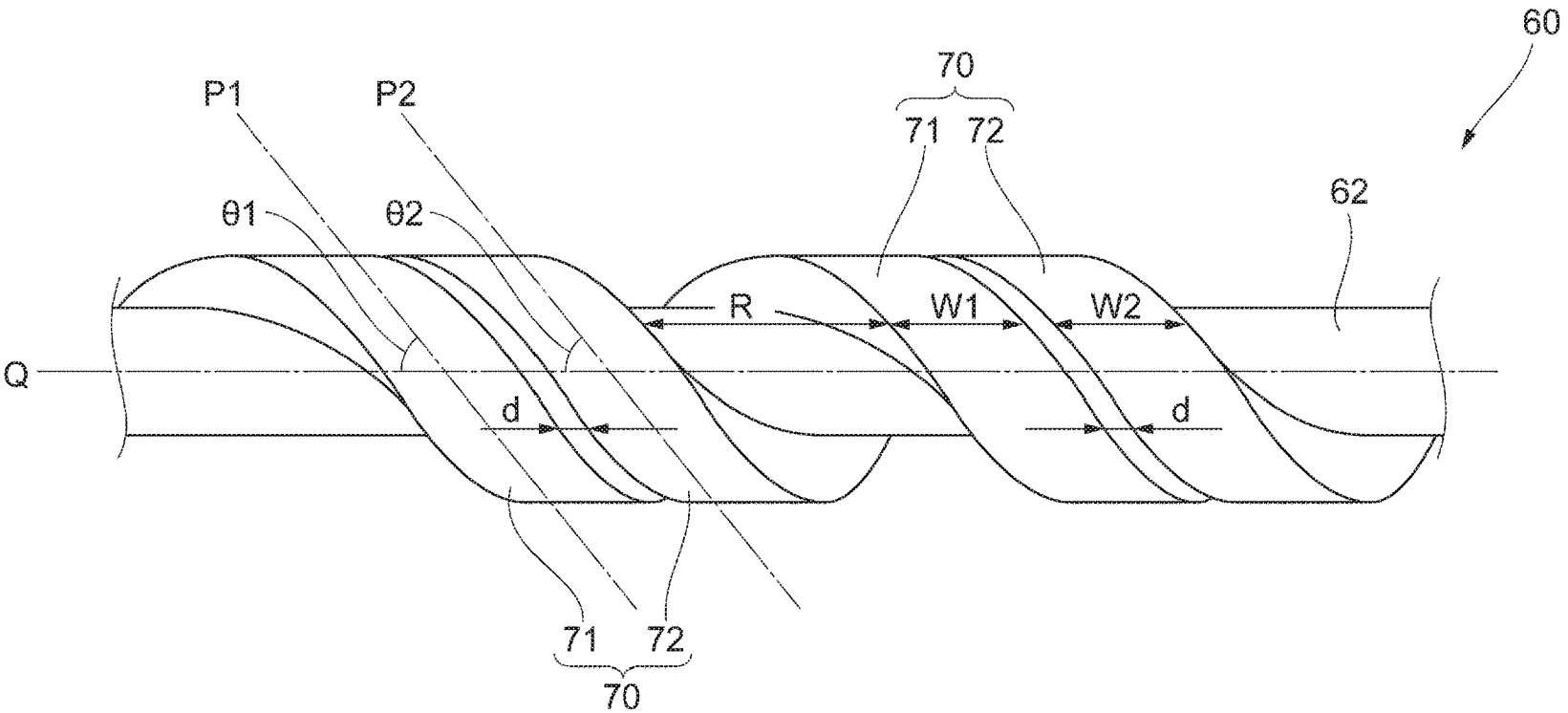
FIG. 5 illustrates a configuration of the foamed elastic layer (first and second foamed elastic layers) according to the exemplary embodiment.
Figure 6A:
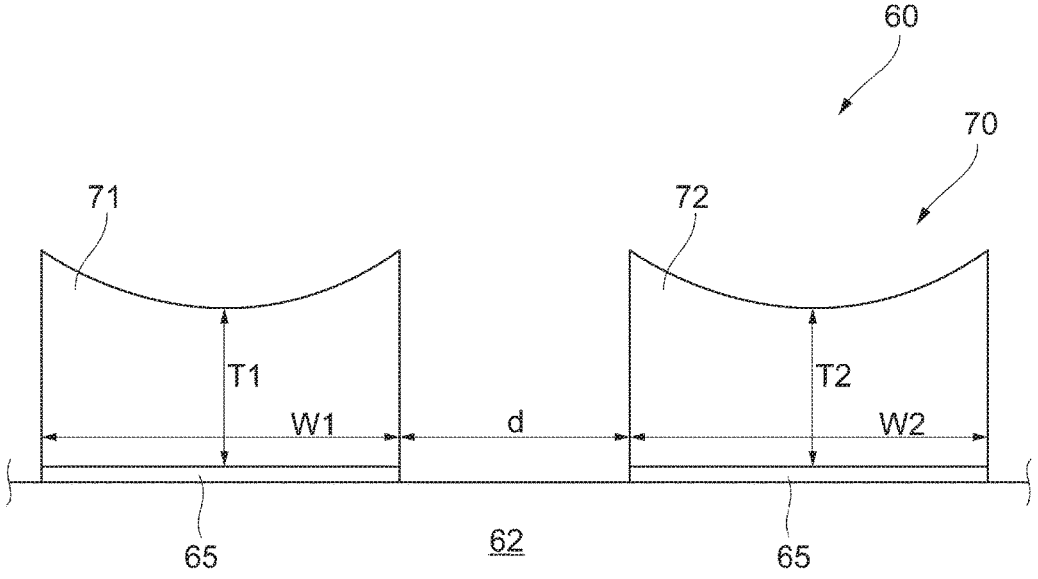
FIGS. 6A and 6B illustrate configurations of the foamed elastic layer (first and second foamed elastic layers) according to the exemplary embodiment.
Figure 6B:
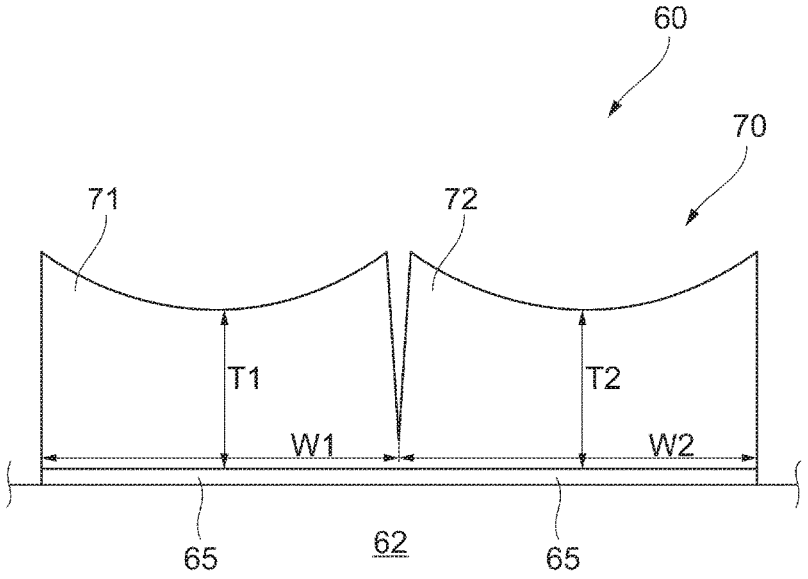

FIG. 5 and FIGS. 6A and 6B illustrate configurations of the foamed elastic layer 70 (the first and second foamed elastic layers 71 and 72) according to the exemplary embodiment. FIG. 5 is an enlarged view of a segment V in FIG. 3, and FIGS. 6A and 6B are enlarged views of sections of the cleaning roller 60 taken along the axial direction of the core 62. FIG. 6A illustrates an enlarged view of a section of the example of the cleaning roller 60 shown in FIGS. 3 to 5, and FIG. 6B illustrates an enlarged view of a section of another example of the cleaning roller 60.

The properties of the foamed elastic layer 70 (the first and second foamed elastic layers 71 and 72), such as the helix widths W1 and W2, the helix angles 81 and 82, the thicknesses T1 and T2, the separation distance d between the first and second foamed elastic layers 71 and 72, and the helix pitch R of the foamed elastic layer 70, may each be determined depending on, for example, how easily the functions of the first and second foamed elastic layers 71 and 72 are exhibited, the function required depending on the surface shape of the charging roller 50 (the charging layer 54), the peel resistance of the material constituting the foamed elastic layer 70, and the ease of production.

Here, as shown in FIG. 5, the helix width W1 of the first foamed elastic layer 71 refers to the length of the first foamed elastic layer 71 in the axial direction (denoted by Q in FIG. 5) of the core 62 around which the first foamed elastic layer 71 is wound in a helical pattern. Likewise, the helix width W2 of the second foamed elastic layer 72 refers to the length of the second foamed elastic layer 72 in the axial direction Q of the core 62 around which the second foamed elastic layer 72 is wound in a helical pattern.

To allow the first and second foamed elastic layers 71 and 72 to easily exhibit their respective functions, the lower limits of the helix width W1 of the first foamed elastic layer 71 and the helix width W2 of the second foamed elastic layer 72 are each preferably 3 mm or more, more preferably 4 mm or more, still more preferably 5 mm or more. The upper limits of the helix width W1 of the first foamed elastic layer 71 and the helix width W2 of the second foamed elastic layer 72 are each preferably 10 mm or less, more preferably 7 mm or less, although depending on the helix angles θ1 and θ2, which will be described later.

The helix width W1 of the first foamed elastic layer 71 and the helix width W2 of the second foamed elastic layer 72 may be the same or different.

As shown in FIG. 5, the helix angle θ1 of the first foamed elastic layer 71 refers to the angle between the axial direction Q of the core 62 and the first foamed elastic layer 71 wound around the core 62 in a helical pattern. Likewise, the helix angle θ2 of the second foamed elastic layer 72 refers to the angle between the axial direction Q of the core 62 and the second foamed elastic layer 72 wound around the core 62 in a helical pattern.

For the first and second foamed elastic layers 71 and 72 to form a double helix, the difference between the helix angle θ1 of the first foamed elastic layer 71 and the helix angle θ2 of the second foamed elastic layer 72 is preferably 5° or less, more preferably 3° or less.

The helix angle θ1 of the first foamed elastic layer 71 and the helix angle θ2 of the second foamed elastic layer 72 are each preferably from 2° to 75°, more preferably from 4° to 75°, still more preferably from 8° to 45°.

As shown in FIGS. 6A and 6B, the thickness T1 of the first foamed elastic layer 71 and the thickness T2 of the second foamed elastic layer 72 refer to the thicknesses at the widthwise centers of the first foamed elastic layers 71 and the second foamed elastic layers 72, respectively. The thickness T1 of the first foamed elastic layer 71 and the thickness T2 of the second foamed elastic layer 72 are measured by the following method. Specifically, the profile of the foamed elastic layer 70 (the thickness of the foamed elastic layer 70) is measured with a laser measuring device (model LSM6200 Laser Scan Micrometer manufactured by Mitutoyo Corporation) by scanning the cleaning roller 60 in the axial direction Q (see FIG. 5) of the cleaning roller 60 at a traverse speed of 1 mm/s with the peripheral direction of the cleaning roller 60 being fixed. The position in the peripheral direction is then shifted, and a measurement is made in the same manner (at a total of three positions at intervals of 120° in the peripheral direction). On the basis of this profile, the thicknesses at the widthwise centers of the first and second foamed elastic layers 71 and 72 are calculated.

The thickness T1 of the first foamed elastic layer 71 and the thickness T2 of the second foamed elastic layer 72 are each preferably from 1.0 mm to 4.0 mm, more preferably from 1.5 mm to 3.0 mm, still more preferably from 1.7 mm to 2.5 mm.

The thickness T1 of the first foamed elastic layer 71 and the thickness T2 of the second foamed elastic layer 72 may be the same or different. If the thickness T1 of the first foamed elastic layer 71 is different from the thickness T2 of the second foamed elastic layer 72, the difference in thickness may be determined depending on, for example, the significance of the functions of the first and second foamed elastic layers 71 and 72. Preferably, one thickness T1 or T2 is from more than 1 time to 1.2 times the other thickness T2 or T1.

The separation distance d between the first and second foamed elastic layers 71 and 72 refers to the distance (spacing), in the axial direction Q of the cleaning roller 60, between the first and second foamed elastic layers 71 and 72 of the foamed elastic layer 70 wound around the core 62 in a double-helical pattern. In this example, the separation distance d between the first and second foamed elastic layers 71 and 72 is the distance between the right side of the first foamed elastic layer 71 and the left side of the second foamed elastic layer 72, as shown in FIG. 5.

The separation distance d between the first and second foamed elastic layers 71 and 72 is preferably from 0 mm to 10 mm, more preferably from 0 mm to 5 mm. In other words, the separation distance d between the first and second foamed elastic layers 71 and 72 may be 0 in such a manner that the first and second foamed elastic layers 71 and 72 are wound such that the side (the right side in FIG. 5 and FIG. 6B) of the first foamed elastic layer 71 and the side (the left side in FIG. 5 and FIG. 6B) of the second foamed elastic layer 72 are in contact with each other along the axial direction Q, as shown in FIG. 6B.

The helix pitch R of the foamed elastic layer 70 refers to the distance, in the axial direction Q of the cleaning roller 60, between a portion of the foamed elastic layer 70 wound around the core 62 in a double-helical pattern and an adjacent portion of the foamed elastic layer 70. In this example, the helix pitch R of the foamed elastic layer 70 is the distance between the right edge of the foamed elastic layer 70 (the right side of the second foamed elastic layer 72) and the left edge of the foamed elastic layer 70 (the left side of the first foamed elastic layer 71), as shown in FIG. 5.

The helix pitch R of the foamed elastic layer 70 is preferably from 3 mm to 25 mm, more preferably from 15 mm to 22 mm.

The helix pitch R of the foamed elastic layer 70 may be larger than the separation distance d between the first and second foamed elastic layers 71 and 72. In this case, if the foamed elastic layer 70 is brought into contact with the surface of the charging roller 50 while the cleaning roller 60 is rotated in the direction denoted by X in FIG. 3, for example, the time period from when the first foamed elastic layer 71 comes into contact with the surface of the charging roller 50 until the second foamed elastic layer 72 comes into contact with the surface of the charging roller 50 is shorter than the time period from when the second foamed elastic layer 72 comes into contact until the first foamed elastic layer 71 comes into contact.

Here, foreign matter adhering to the surface of the charging roller 50 is scraped off the surface of the charging roller 50 as a result of the contact of the first foamed elastic layer 71. In this case, foreign matter remaining on the surface of the charging roller 50 without being scraped off by the first foamed elastic layer 71 has presumably become softer, by being rubbed by the first foamed elastic layer 71, than before the contact of the first foamed elastic layer 71. Therefore, it is presumed that if the time period from when foreign matter adhering to the surface of the charging roller 50 is scraped off by the first foamed elastic layer 71 until foreign matter remaining on the surface of the charging roller 50 is leveled by the second foamed elastic layer 72 is short, the foreign matter on the surface of the charging roller 50 may easily be leveled by the second foamed elastic layer 72.

Therefore, the configuration in which the helix pitch R of the foamed elastic layer 70 is larger than the separation distance d between the first and second foamed elastic layers 71 and 72 may further suppress the in-plane variation of foreign matter present on the surface of the charging roller 50.

To reduce the likelihood that a rotation error occurs when the cleaning roller 60 is rotated by the rotation of the charging roller 50 as in the exemplary embodiment, and to allow the first and second foamed elastic layers 71 and 72 to easily exhibit their respective functions, the numbers of turns of the first and second foamed elastic layers 71 and 72 around the core 62 are each preferably 1 or more, more preferably 1.3 or more, still more preferably 2 or more. When the cleaning roller 60 is rotated by the rotation of the charging roller 50, there is no particular upper limit to the numbers of turns of the first and second foamed elastic layers 71 and 72 since the numbers of turns depend on the length of the core 62.

When the cleaning roller 60 is rotated not by the rotation of the charging roller 50 but by itself, there is no particular upper limit to the numbers of turns of the first and second foamed elastic layers 71 and 72 around the core 62.

Next, the adhesive layer 65 will be described. As described above, in the cleaning roller 60, the foamed elastic layer 70 is bonded to the core 62 with the adhesive layer 65 interposed therebetween.

The adhesive layer 65 may be any layer capable of bonding the core 62 and the foamed elastic layer 70 together. For example, the adhesive layer 65 may be formed of a double-sided tape or any other adhesive.

Here, as shown in FIG. 6B, the cleaning roller 60 may be disposed around the core 62 with the separation distance d between the first and second foamed elastic layers 71 and 72 being 0, that is, with one side of the first foamed elastic layer 71 and the opposing side of the second foamed elastic layer 72 in contact with each other. When such a configuration is employed, the adhesive layer 65 may be formed of a single layer so as to simultaneously bond the first and second foamed elastic layers 71 and 72, as shown in FIG. 6B, or the adhesive layer 65 may be separately provided for each of the first and second foamed elastic layers 71 and 72.

Method for Producing Cleaning Roller

Figure 7A:
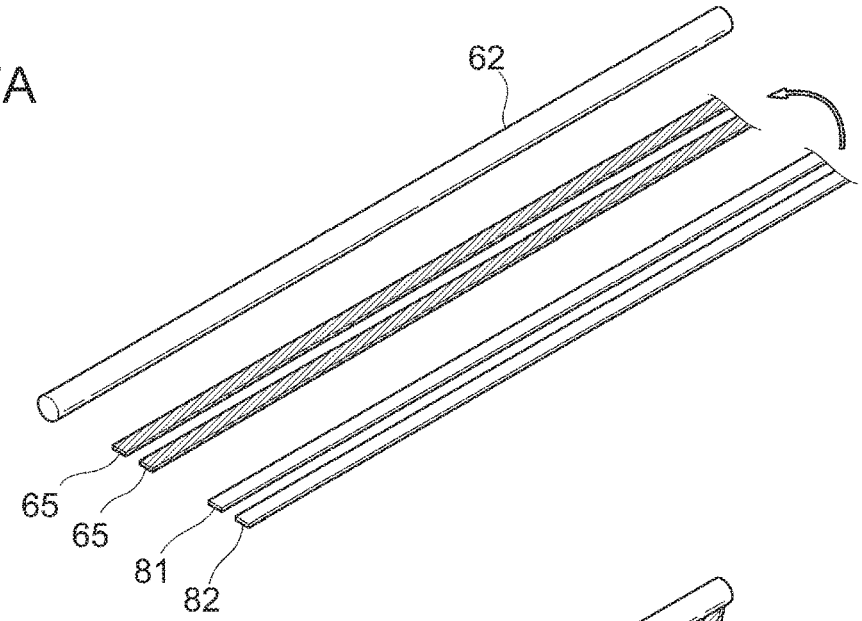
FIGS. 7A to 7C illustrate exemplary steps of a method for producing a cleaning roller.
Figure 7B:
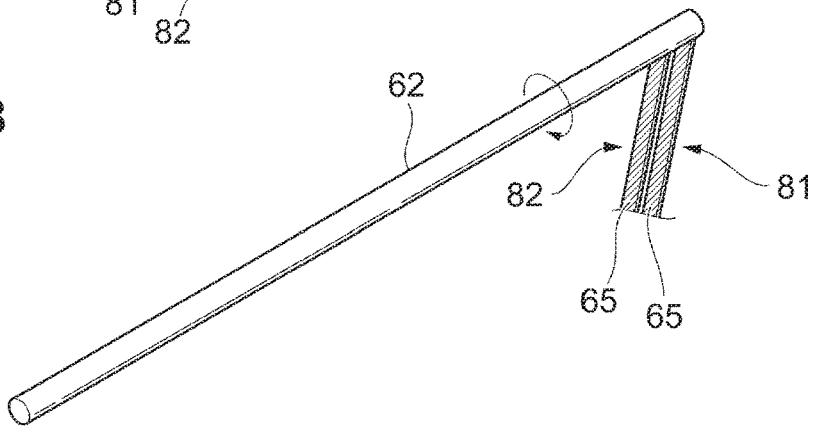
Figure 7C:
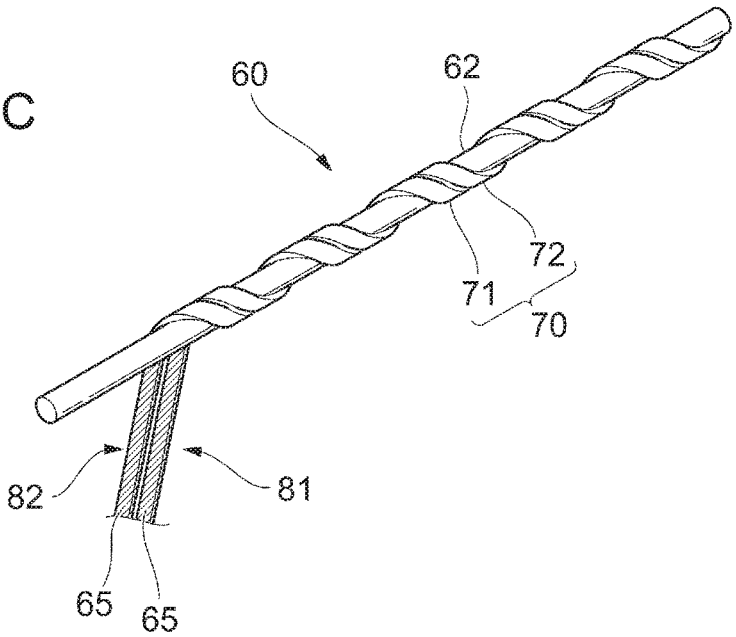

Next, an exemplary method for producing the cleaning roller 60 according to the exemplary embodiment will be described. FIGS. 7A to 7C illustrate exemplary steps of the method for producing the cleaning roller 60.

As shown in FIG. 7A, to obtain the first and second foamed elastic layers 71 and 72, sheet-shaped foamed elastic members (e.g., foamed polyurethane sheets) each sliced to the desired thickness are first provided. These sheet-shaped foamed elastic members are cut to obtain strip-shaped foamed elastic members 81 and 82 each having the desired width and length.

The adhesive layers 65 formed of double-sided tapes and having adhesive surfaces of the same size as the strip-shaped foamed elastic members 81 and 82 are provided. The double-sided tapes, serving as the adhesive layers 65, are then attached to the strip-shaped foamed elastic members 81 and 82 on their one surface.

The core 62 is also provided.

Next, as shown in FIG. 7B, the strip-shaped foamed elastic members 81 and 82 (the strips with the double-sided tapes) are placed such that the double-sided tapes constituting the adhesive layers 65 face upward. In this state, one end of the release paper of each of the double-sided tapes constituting the adhesive layers 65 is stripped. An end portion of the core 62 is then placed on the portions of the double-sided tapes (the adhesive layers 65) from each of which the release paper has been stripped.

Subsequently, as shown in FIG. 7C, the release paper of each of the double-sided tapes constituting the adhesive layers 65 is stripped while the core 62 is rotated at the desired speed to wind the strip-shaped foamed elastic members 81 and 82 around the outer peripheral surface of the core 62 in a double-helical pattern. In this manner, the cleaning roller 60 including the first and second foamed elastic layers 71 and 72 disposed around the outer peripheral surface of the core 62 in a double-helical pattern is obtained.

Although the method illustrated in FIGS. 7A to 7C involves simultaneously winding the strip-shaped foamed elastic members 81 and 82 around the core 62, the method for producing the cleaning roller 60 is not limited thereto. It is also possible to wind the foamed elastic member 81 around the core 62 and then wind the foamed elastic member 82 around the core 62 or to wind the foamed elastic members 81 and 82 in the reverse order.

Here, the helix angle θ1 of the first foamed elastic layer 71 and the helix angle θ2 of the second foamed elastic layer 72 may be adjusted to the desired angles in the following manner. In winding the foamed elastic members 81 and 82 around the core 62, the core 62 and the foamed elastic members 81 and 82 are positioned such that the longitudinal direction of the foamed elastic members 81 and 82 makes the desired angle with the axial direction of the core 62.

If a tension is applied when the foamed elastic members 81 and 82 are wound around the core 62, the tension may be high enough to leave no gap between the core 62 and the adhesive layers 65 (the double-sided tapes) bonded to the foamed elastic members 81 and 82. Specifically, for example, the tension may be high enough to elongate the foamed elastic members 81 and 82 by 0% or more and 5% or less of their original length.

The foamed elastic members 81 and 82 tend to elongate as the foamed elastic members 81 and 82 are wound around the core 62. This elongation differs in the thickness direction of the foamed elastic members 81 and 82, with the outermost portion of the foamed elastic members 81 and 82 tending to elongate more. Accordingly, the elongation of the outermost portion of the foamed elastic members 81 and 82 after the winding of the foamed elastic members 81 and 82 around the core 62 may be about 5% of the original length of the outermost portion of the foamed elastic members 81 and 82. An excessive elongation of the foamed elastic members 81 and 82 may decrease the elastic force of the first and second foamed elastic layers 71 and 72.

The elongation of the foamed elastic members 81 and 82 is controlled by the radius of curvature of the foamed elastic members 81 and 82 wound around the core 62 and the thickness of the foamed elastic members 81 and 82. The radius of curvature of the foamed elastic members 81 and 82 wound around the core 62 is controlled by the outer diameter of the core 62 and the angles (the helix angles θ1 and 02) at which the foamed elastic members 81 and 82 are wound around the core 62.

For example, the radius of curvature of the foamed elastic members 81 and 82 wound around the core 62 is preferably from ((outer diameter of core 62/2)+1 mm) to ((outer diameter of core 62/2)+15 mm), more preferably from ((outer diameter of core 62/2)+1.5 mm) to ((outer diameter of core 62/2)+5.0 mm).

The longitudinal ends of the foamed elastic members 81 and 82 may be provided with regions where the foamed elastic members 81 and 82 are subjected to compression treatment in the thickness direction. Performing compression treatment on the foamed elastic members 81 and 82 may suppress peeling off of the foamed elastic members 81 and 82 after being bonded to the core 62.

Specifically, the longitudinal ends of the foamed elastic members 81 and 82 before being bonded to the core 62 may be subjected to compression treatment (thermal compression treatment) in which heat and pressure are applied so that the percentage of compression in the thickness direction of the foamed elastic members 81 and 82 ((thickness after compression/thickness before compression)×100) is from 10% to 70%. By this compression treatment, the longitudinal ends of the foamed elastic members 81 and 82 are plastically deformed into a flat shape.

While in the exemplary embodiment, the cleaning roller 60, which is an example of a cleaning member, is in contact with the surface of the charging roller 50, which is an example of a member to be cleaned, and is rotated by the rotation of the charging roller 50, this configuration is a non-limiting example. As in the exemplary embodiment, the configuration in which the cleaning roller 60 is in constant contact with the surface of the charging roller 50 and is rotated by the rotation of the charging roller 50 may be employed. Alternatively, for example, a configuration in which the cleaning roller 60 comes into contact with the charging roller 50 only during cleaning of the charging roller 50 and is rotated by the rotation of the charging roller 50, or a configuration in which the cleaning roller 60 comes into contact with the charging roller 50 only during cleaning of the charging roller 50 and is independently driven to rotate may be employed.

While in the exemplary embodiment, the cleaning roller 60 that cleans a surface of the charging roller 50 of the charging device 100 has been described as an example of a cleaning member, the cleaning member having the configuration described above may be a member that cleans a member to be cleaned other than the charging roller 50. Also in this case, the cleaning member includes a foamed elastic layer 70 having first and second foamed elastic layers 71 and 72, wherein the compressive stress F1 of the first foamed elastic layer 71 is greater than the compressive stress F2 of the second foamed elastic layer 72.

Examples of members to be cleaned other than the charging roller 50 include transfer members, sheet transport belts, second transfer members (e.g., second transfer rollers) for intermediate transfer systems, and intermediate transfer bodies (e.g., intermediate transfer belts) for intermediate transfer systems. Furthermore, such a member to be cleaned and a cleaning member disposed in contact therewith may be combined into a unit for an image forming apparatus.

The image forming apparatus 1 according to the exemplary embodiment is not limited to the monochrome printer shown in FIG. 1 and may be, for example, an image forming apparatus 1 having a known configuration, such as a tandem color printer. In the image forming apparatus 1 according to the exemplary embodiment, the internal devices and members need not be assembled into a cartridge but each may be directly disposed.

EXAMPLES

The present invention will hereinafter be described in more detail with reference to examples. It should be noted that exemplary embodiments of the present invention are not limited to the following examples.

Examples 1 to 14 and Comparative Examples 1 and 2

(1) Fabrication of Foamed Elastic Members

Fabrication of Foamed Elastic Member 1

A melamine foam sheet (BASOTECT Type G) available from Inoac Corporation is used to obtain a sheet-shaped foamed elastic member 1 having a thickness of 2.4 mm.

Fabrication of Foamed Elastic Member 2

A urethane sheet (EP-70) available from Inoac Corporation is used to obtain a sheet-shaped foamed elastic member 2 having a thickness of 2.4 mm.

Fabrication of Foamed Elastic Member 3

A urethane sheet (ER-1) available from Inoac Corporation is used to obtain a sheet-shaped foamed elastic member 3 having a thickness of 2.4 mm.

Fabrication of Foamed Elastic Member 4

A urethane sheet (MF-40) available from Inoac Corporation is used to obtain a sheet-shaped foamed elastic member 4 having a thickness of 2.4 mm.

Fabrication of Foamed Elastic Member 5

A urethane sheet (MF-30) available from Inoac Corporation is used to obtain a sheet-shaped foamed elastic member 5 having a thickness of 2.4 mm.

Fabrication of Foamed Elastic Member 6

A urethane sheet (MF-20) available from Inoac Corporation is used to obtain a sheet-shaped foamed elastic member 6 having a thickness of 2.4 mm.

Fabrication of Foamed Elastic Member 7

A urethane sheet (MF-13) available from Inoac Corporation is used to obtain a sheet-shaped foamed elastic member 7 having a thickness of 2.4 mm.

Fabrication of Foamed Elastic Member 8

A urethane sheet (MF-8) available from Inoac Corporation is used to obtain a sheet-shaped foamed elastic member 8 having a thickness of 2.4 mm.

Fabrication of Foamed Elastic Member 9

A urethane sheet (MF-20) available from Inoac Corporation is used to obtain a sheet-shaped foamed elastic member 9 having a thickness of 2.3 mm.

(2) Fabrication of Cleaning Roller

Fabrication of Cleaning Roller 1

The sheet-shaped foamed elastic members 2 and 6 are each cut into a strip having a width of 5 mm and a length of 360 mm.

To each cut-out strip, a double-sided tape having a thickness of 0.05 mm (No. 5605, available from Nitto Denko Corporation) is attached over the entire surface to be attached to a core to obtain two strips with the double-sided tapes.

The two resulting strips with the double-sided tapes are placed on a horizontal stage such that the release paper attached to each double-sided tape faces downward. Both of the two strips are then compressed from thereabove with stainless steel having its longitudinal ends heated so that the thickness of portions longitudinally extending 1 mm from the longitudinal ends of each strip is 15% of the thickness of the remaining portion.

The two strips with the double-sided tapes are then placed on a horizontal stage at a distance of 0 mm (i.e., in contact with each other) such that the release paper attached to each double-sided tape faces upward. The two strips with the double-sided tapes are then wound around a metal core (material, SUM24EZ; outer diameter, 5.0 mm; overall length, 338 mm) in a double-helical pattern at helix angles θ1 and θ2 of 25° while being tensioned so that the overall length of each strip increases by 0% to 5%.

By the foregoing process, a cleaning roller 1 including first and second foamed elastic layers disposed around the outer peripheral surface of a core in a double-helical pattern is obtained.

The compressive stresses F1 and F2 and their ratio F1/F2, the average skeleton sizes D1 and D2, the sheet widths W1 and W2, the helix angles θ1 and θ2, the separation distance d, and the thicknesses T1 and T2 of the cleaning roller 1 are shown in Table 1 below.

Fabrication of Cleaning Rollers 2 to 11

Cleaning rollers 2 to 11 each including two foamed elastic layers disposed around the outer peripheral surface of a core in a double-helical pattern are obtained in the same manner as in Fabrication of Cleaning Roller 1 except that the foamed elastic members 2 and 6 cut into strips are replaced with foamed elastic members shown in Table 1 below.

The compressive stresses F1 and F2 and their ratio F1/F2, the average skeleton sizes D1 and D2, the sheet widths W1 and W2, the helix angles θ1 and θ2, the separation distance d, and the thicknesses T1 and T2 of the cleaning rollers 2 to 11 are shown in Table 1 below.

Fabrication of Cleaning Roller 12

The sheet-shaped foamed elastic members 2 and 6 are each cut into a strip having a width of 4 mm and a length of 360 mm.

A cleaning roller 12 including first and second foamed elastic layers disposed around the outer peripheral surface of a core in a double-helical pattern is obtained in the same manner as in Fabrication of Cleaning Roller 1 except that these strips are used.

The compressive stresses F1 and F2 and their ratio F1/F2, the average skeleton sizes D1 and D2, the sheet widths W1 and W2, the helix angles θ1 and θ2, the separation distance d, and the thicknesses T1 and T2 of the cleaning roller 12 are shown in Table 1 below.

Fabrication of Cleaning Roller 13

A cleaning roller 13 including first and second foamed elastic layers disposed around the outer peripheral surface of a core in a double-helical pattern is obtained in the same manner as the cleaning roller 1 except that the two strips with the double-sided tapes are wound around a core at helix angles θ1 and θ2 of 15°.

The compressive stresses F1 and F2 and their ratio F1/F2, the average skeleton sizes D1 and D2, the sheet widths W1 and W2, the helix angles θ1 and θ2, the separation distance d, and the thicknesses T1 and T2 of the cleaning roller 13 are shown in Table 1 below.

Fabrication of Cleaning Roller 14

A cleaning roller 14 including first and second foamed elastic layers disposed around the outer peripheral surface of a core in a double-helical pattern is obtained in the same manner as the cleaning roller 1 except that the two strips with the double-sided tapes are wound around a core with the separation distance d therebetween set to 2 mm.

The compressive stresses F1 and F2 and their ratio F1/F2, the average skeleton sizes D1 and D2, the sheet widths W1 and W2, the helix angles θ1 and θ2, the separation distance d, and the thicknesses T1 and T2 of the cleaning roller 14 are shown in Table 1 below.

TABLE 1

| Cleaning roller | Foamed elastic layer No. | | Compressive stress [kPa] | | Compressive stress ratio | Average skeleton size [μm] | | Sheet width [mm] | | Helix angle [°] | | Separation distance d | Thickness [mm] | |
|---|---|---|---|---|---|---|---|---|---|---|---|---|---|---|
| No. | First | Second | F1 | F2 | F1/F2 | D1 | D2 | W1 | W2 | θ1 | θ2 | [mm] | T1 | T2 |
| 1 | 2 | 6 | 12.7 | 12.6 | 1.01 | 60 | 140 | 5 | 5 | 25 | 25 | 0 | 2.4 | 2.4 |
| 2 | 4 | 8 | 16.3 | 8.8 | 1.85 | 100 | 270 | 5 | 5 | 25 | 25 | 0 | 2.4 | 2.4 |
| 3 | 1 | 6 | 16.4 | 12.6 | 1.30 | 40 | 140 | 5 | 5 | 25 | 25 | 0 | 2.4 | 2.4 |
| 4 | 4 | 6 | 16.3 | 12.6 | 1.29 | 100 | 140 | 5 | 5 | 25 | 25 | 0 | 2.4 | 2.4 |
| 5 | 4 | 4 | 16.3 | 16.3 | 1.00 | 100 | 100 | 5 | 5 | 25 | 25 | 0 | 2.4 | 2.4 |
| 6 | 2 | 8 | 12.7 | 8.8 | 1.44 | 60 | 270 | 5 | 5 | 25 | 25 | 0 | 2.4 | 2.4 |
| 7 | 3 | 6 | 11.5 | 12.6 | 0.91 | 70 | 140 | 5 | 5 | 25 | 25 | 0 | 2.4 | 2.4 |
| 8 | 2 | 5 | 12.7 | 12.6 | 1.01 | 60 | 120 | 5 | 5 | 25 | 25 | 0 | 2.4 | 2.4 |
| 9 | 6 | 8 | 12.6 | 8.8 | 1.43 | 140 | 270 | 5 | 5 | 25 | 25 | 0 | 2.4 | 2.4 |
| 10 | 4 | 7 | 16.3 | 12.6 | 1.29 | 100 | 240 | 5 | 5 | 25 | 25 | 0 | 2.4 | 2.4 |
| 11 | 2 | 9 | 12.7 | 12.5 | 1.02 | 60 | 140 | 5 | 5 | 25 | 25 | 0 | 2.4 | 2.3 |
| 12 | 2 | 6 | 12.7 | 12.6 | 1.01 | 60 | 140 | 4 | 4 | 25 | 25 | 0 | 2.4 | 2.4 |
| 13 | 2 | 6 | 12.7 | 12.6 | 1.01 | 60 | 140 | 5 | 5 | 15 | 15 | 0 | 2.4 | 2.4 |
| 14 | 2 | 6 | 12.7 | 12.6 | 1.01 | 60 | 140 | 5 | 5 | 25 | 25 | 2 | 2.4 | 2.4 |

(3) Fabrication of Charging Rollers

Fabrication of Charging Roller 1

Formation of Charging Layer

The following mixture for forming an elastic layer is kneaded in an open roll mill and is applied to the outer peripheral surface of a conductive charging shift formed of SUS416 stainless steel and having a diameter of 9 mm to form a cylindrical coating having a thickness of 1.5 mm. The coated core is placed in a cylindrical mold having an inner diameter of 12.0 mm, is vulcanized at 170° C. for 30 minutes, and is removed from the mold, following by surface polishing. In this manner, a cylindrical conductive elastic layer formed around the outer peripheral surface of the charging shift is obtained.

Mixture for Forming Elastic Layer

- Rubber material (epichlorohydrin-ethylene oxide-allyl glycidyl ether copolymer rubber, GECHRON 3106, available from Zeon Corporation) 100 parts by mass
- Conductor (carbon black ASAHI THERMAL, available from Asahi Carbon Co., Ltd.) 25 parts by mass
- Conductor (KETJEN BLACK EC: available from Lion Corporation) 8 parts by mass
- Ionic conductor (lithium perchlorate) 1 part by mass
- Vulcanizing agent (sulfur, 200 mesh, available from Tsurumi Chemical Industry Co., Ltd.) 1 part by mass
- Vulcanization accelerator (NOCCELER DM, available from Ouchi Shinko Chemical Industrial Co., Ltd.) 2.0 parts by mass
- Vulcanization accelerator (NOCCELER TT, available from Ouchi Shinko Chemical Industrial Co., Ltd.) 0.5 parts by mass Formation of Surface Layer The following mixture for forming a surface layer is dispersed with a bead mill, and the resulting dispersion is diluted with methanol. The diluted dispersion is applied to the surface (outer peripheral surface) of the above conductive elastic layer by dip coating and then dried by heating at 140° C. for 15 minutes. In this manner, a charging roller 1 including the conductive elastic layer and a 4-μm-thick surface layer formed on the surface thereof is obtained.

The average spacing Sm of irregularities in the surface of the charging roller 1 is 90 μm.

Mixture for Forming Surface Layer

- Polymeric material (N-alkoxymethylated polyamide, "TORESIN", available from Nagase ChemteX Corporation) 100 parts by mass
- Conductor (carbon black MONARCH 1000, available from Cabot Corporation) 30 parts by mass
- Solvent (methanol) 500 parts by mass
- Solvent (butanol) 240 parts by mass Fabrication of Charging Roller 2

A charging roller 2 is obtained in the same manner as in Fabrication of Charging Roller 1 except that the following mixture for forming a surface layer is used to form a surface layer.

The average spacing Sm of irregularities in the surface of the charging roller 2 is 180 μm.

Mixture for Forming Surface Layer

- Polymeric material (N-alkoxymethylated polyamide, FINE RESIN, available from Namariichi Co., Ltd.) 100 parts by mass
- Conductor (carbon black MONARCH 1000, available from Cabot Corporation) 30 parts by mass
- Solvent (methanol) 500 parts by mass
- Solvent (butanol) 240 parts by mass (4) Evaluation Each combination of a cleaning roller and a charging roller shown in Table 2 below is attached to a drum cartridge for a DocuCentre-V C7775 color multifunction machine (manufactured by Fuji Xerox Co., Ltd.) and is evaluated for cleaning performance.

Evaluation of Cleaning Performance

A strip-like image pattern with a length in the output direction of 320 mm and a width of 30 mm is printed on sheets of A3 recording paper at an image density of 100% in an environment at 22° C. and 55% RH. The charging roller is inspected for deposits at the image pattern printing position each time 10,000 sheets are printed.

The inspection of deposits is performed by directly observing the surface of the charging roller under a confocal laser microscope (OLS1100, manufactured by Olympus Corporation), and the cleaning performance is evaluated.

Specifically, the inspection of deposits is performed on the surface layer of the charging roller at two points located 10 mm inward of the opposite axial ends and at three points dividing the distance between the two points into four segments of equal length. The number of rotations of the photoconductor drum at which G3 on the following criteria is reached is determined.

For each of the above five points on the surface layer of the charging roller, deposits are inspected at the center of the point and at two points located ±1 mm from the center, i.e., at a total of three points. The number of rotations of the photoconductor drum at which the maximum difference in deposit area between any three points among the five points reaches 40% or more is determined.

The cleaning performance is evaluated on the basis of the number of rotations of the photoconductor drum at which any of these two measures is reached. A larger number of photoconductors in the photoconductor drum indicates a better cleaning performance.

Criteria

G0: Deposits are found at a percentage of 10% or less per $\mu m^2$ on the surface of the charging roller.

G0.5: Deposits are found at a percentage of more than 10% and 20% or less per $\mu m^2$ on the surface of the charging roller.

G1: Deposits are found at a percentage of more than 20% and 30% or less per $\mu m^2$ on the surface of the charging roller.

G2: Deposits are found at a percentage of more than 30% and 50% or less per $\mu m^2$ on the surface of the charging roller.

G3: Deposits are found at a percentage of more than 50% per $\mu m^2$ on the surface of the charging roller.

TABLE 2

| | Charging roller | Cleaning roller | Compressive stress ratio | Relationship between Sm and average skeleton sizes D1 and D2 | | | Cleaning performace × 10,000 |
|---|---|---|---|---|---|---|---|
| | No. | No. | F1/F2 | D1 [μm] | Sm [μm] | D2 [μm] | rotations |
| Example 1 | 1 | 1 | 1.01 | 60 | 90 | 140 | 100 |
| Example 2 | 1 | 3 | 1.30 | 40 | 90 | 140 | 95 |
| Example 3 | 1 | 6 | 1.44 | 60 | 90 | 270 | 95 |

TABLE 2-continued

| | Charging roller | Cleaning roller | Compressive stress ratio | Relationship between Sm and average skeleton sizes D1 and D2 | | | Cleaning performace × 10,000 |
|---|---|---|---|---|---|---|---|
| | No. | No. | F1/F2 | D1 [μm] | Sm [μm] | D2 [μm] | rotations |
| Example 4 | 1 | 8 | 1.01 | 60 | 90 | 120 | 92 |
| Example 5 | 2 | 2 | 1.85 | 100 | 180 | 270 | 110 |
| Example 6 | 2 | 9 | 1.43 | 140 | 180 | 270 | 95 |
| Example 7 | 2 | 6 | 1.44 | 60 | 180 | 270 | 95 |
| Example 8 | 2 | 10 | 1.29 | 100 | 180 | 240 | 95 |
| Example 9 | 1 | 11 | 1.02 | 60 | 90 | 140 | 100 |
| Example 10 | 1 | 12 | 1.01 | 60 | 90 | 140 | 100 |
| Example 11 | 1 | 13 | 1.01 | 60 | 90 | 140 | 100 |
| Example 12 | 1 | 14 | 1.01 | 60 | 90 | 140 | 100 |
| Example 13 | 2 | 4 | 1.29 | 100 | 180 | 140 | 92 |
| Example 14 | 1 | 4 | 1.29 | 100 | 90 | 140 | 92 |
| Comparative Example 1 | 2 | 5 | 1.00 | 100 | 180 | 100 | 85 |
| Comparative Example 2 | 1 | 7 | 0.91 | 70 | 90 | 140 | 90 |

The above results demonstrate that the cleaning performance is maintained over a longer period of time in Examples 1 to 14 than in Comparative Examples 1 and 2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a core; and first and second foamed elastic layers wound around an outer peripheral surface of the core in a double-helical pattern, wherein a compressive stress F1 of the first foamed elastic layer is greater than a compressive stress F2 of the second foamed elastic layer, and the cleaning member cleans a member to be cleaned with the first and second foamed elastic layers in contact with a surface of the member to be cleaned.

2. The cleaning member according to claim 1, wherein an average skeleton size D1 of the first foamed elastic layer is smaller than an average skeleton size D2 of the second foamed elastic layer.

3. The cleaning member according to claim 2, wherein the compressive stress F1 of the first foamed elastic layer is in a range of from about 10 kPa to about 20 kPa.

4. The cleaning member according to claim 3, wherein the compressive stress F2 of the second foamed elastic layer is in a range of from about 7 kPa to about 12 kPa.

5. The cleaning member according to claim 4, wherein F1/F2, which is a ratio of the compressive stress F1 of the first foamed elastic layer to the compressive stress F2 of the second foamed elastic layer, is in a range of from more than about 1 to about 2.

6. The cleaning member according to claim 4, wherein the member to be cleaned charges an object to be charged and has a surface in which irregularities having an average spacing Sm are formed, and the average skeleton size D1 of the first foamed elastic layer is smaller than the average spacing Sm of the irregularities of the member to be cleaned, and the average skeleton size D2 of the second foamed elastic layer is larger than the average spacing Sm of the irregularities of the member to be cleaned.

7. The cleaning member according to claim 3, wherein F1/F2, which is a ratio of the compressive stress F1 of the first foamed elastic layer to the compressive stress F2 of the second foamed elastic layer, is in a range of from more than about 1 to about 2.

8. The cleaning member according to claim 3, wherein the member to be cleaned charges an object to be charged and has a surface in which irregularities having an average spacing Sm are formed, and the average skeleton size D1 of the first foamed elastic layer is smaller than the average spacing Sm of the irregularities of the member to be cleaned, and the average skeleton size D2 of the second foamed elastic layer is larger than the average spacing Sm of the irregularities of the member to be cleaned.

9. The cleaning member according to claim 2, wherein the member to be cleaned charges an object to be charged and has a surface in which irregularities having an average spacing Sm are formed, and the average skeleton size D1 of the first foamed elastic layer is smaller than the average spacing Sm of the irregularities of the member to be cleaned, and the average skeleton size D2 of the second foamed elastic layer is larger than the average spacing Sm of the irregularities of the member to be cleaned.

10. The cleaning member according to claim 1, wherein the compressive stress F1 of the first foamed elastic layer is in a range of from about 10 kPa to about 20 kPa.

11. The cleaning member according to claim 10, wherein the compressive stress F2 of the second foamed elastic layer is in a range of from about 7 kPa to about 12 kPa.

12. The cleaning member according to claim 11, wherein F1/F2, which is a ratio of the compressive stress F1 of the first foamed elastic layer to the compressive stress F2 of the second foamed elastic layer, is in a range of from more than about 1 to about 2.

13. The cleaning member according to claim 11, wherein the member to be cleaned charges an object to be charged and has a surface in which irregularities having an average spacing Sm are formed, and the average skeleton size D1 of the first foamed elastic layer is smaller than the average spacing Sm of the irregularities of the member to be cleaned, and the average skeleton size D2 of the second foamed elastic layer is larger than the average spacing Sm of the irregularities of the member to be cleaned.

14. The cleaning member according to claim 10, wherein F1/F2, which is a ratio of the compressive stress F1 of the first foamed elastic layer to the compressive stress F2 of the second foamed elastic layer, is in a range of from more than about 1 to about 2.

15. The cleaning member according to claim 14, wherein the member to be cleaned charges an object to be charged and has a surface in which irregularities having an average spacing Sm are formed, and the average skeleton size D1 of the first foamed elastic layer is smaller than the average spacing Sm of the irregularities of the member to be cleaned, and the average skeleton size D2 of the second foamed elastic layer is larger than the average spacing Sm of the irregularities of the member to be cleaned.

16. The cleaning member according to claim 10, wherein the member to be cleaned charges an object to be charged and has a surface in which irregularities having an average spacing Sm are formed, and the average skeleton size D1 of the first foamed elastic layer is smaller than the average spacing Sm of the irregularities of the member to be cleaned, and the average skeleton size D2 of the second foamed elastic layer is larger than the average spacing Sm of the irregularities of the member to be cleaned.

17. The cleaning member according to claim 1, wherein the first foamed elastic layer scrapes off foreign matter from the surface of the member to be cleaned, and the second foamed elastic layer levels the foreign matter on the surface of the member to be cleaned.

18. The cleaning member according to claim 17, wherein the member to be cleaned charges an object to be charged, and the cleaning member rotates with the first and second foamed elastic layers in contact with the surface of the member to be cleaned, and a time period from when the first foamed elastic layer comes into contact with the surface of the member to be cleaned until the second foamed elastic layer comes into contact with the surface of the member to be cleaned is shorter than a time period from when the second foamed elastic layer comes into contact until the first foamed elastic layer comes into contact.

19. A cleaning member comprising:

a core;

a first foamed elastic layer wound around an outer peripheral surface of the core in a helical pattern; and a second foamed elastic layer wound around the outer peripheral surface of the core in a helical pattern adjacently to the first foamed elastic layer, the second foamed elastic layer having an average skeleton size larger than or equal to that of the first foamed elastic layer and a hardness lower than that of the first foamed elastic layer.

20. An image forming apparatus comprising:

an image carrier;

a charging member that charges a surface of the image carrier; and a cleaning member including a core and first and second foamed elastic layers wound around an outer peripheral surface of the core in a double-helical pattern, wherein a compressive stress F1 of the first foamed elastic layer is greater than a compressive stress F2 of the second foamed elastic layer, and the cleaning member cleans the charging member with the first and second foamed elastic layers in contact with a surface of the charging member.

* * * * *